US007622035B2

(12) United States Patent
Zaki et al.

(10) Patent No.: US 7,622,035 B2
(45) Date of Patent: Nov. 24, 2009

(54) METHODS OF DERESINATING CRUDE OILS USING CARBON DIOXIDE

(75) Inventors: Nael Naguib Zaki, Raleigh, NC (US); Peter Kelley Kilpatrick, Cary, NC (US); Ruben Guillermo Carbonell, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 09/951,090

(22) Filed: Sep. 13, 2001

(65) Prior Publication Data

US 2002/0096453 A1 Jul. 25, 2002

Related U.S. Application Data

(60) Provisional application No. 60/232,539, filed on Sep. 14, 2000.

(51) Int. Cl.
*C10C 3/08* (2006.01)

(52) U.S. Cl. ..... 208/309; 208/45; 208/311; 208/313; 208/339

(58) Field of Classification Search ..... 208/309, 208/44, 45, 53, 56, 87
See application file for complete search history.

(56) References Cited

U.S. PATENT DOCUMENTS 2,446,040 A 7/1948 Blair, Jr. ..... 252/327
5,100,582 A 3/1992 Bhattacharyya ..... 252/340
5,460,750 A 10/1995 Diaz-Arauzo ..... 252/331
5,525,201 A 6/1996 Diaz-Arauzo et al. ..... 204/573
5,607,574 A 3/1997 Hart ..... 208/188
5,746,908 A 5/1998 Mitchell ..... 208/251 R
5,948,242 A 9/1999 Obsol et al. ..... 208/181

OTHER PUBLICATIONS

Eckermann et al.; "Deasphaltization and Demetalling of Heavy Crude Oils" *Chem. Eng. Technol.* 13:258-264 (1990).
Kassim et al.; "Near Critical Carbon Dioxide Fractionation of Crude Oil" *Fuel Science and Technology Int'l.* 71:2 207-215 (1989).
Sayegh et al.; "Phase Behavior Properties of $CO_2$/Heavy Oil Mixtures for EOR Applications" SPE 20037, *Society of Petroleum Engineers, 60th California Regional Meeting*, Ventura California, Apr. 4-6, 1990.
Sayegh et al.; "Phase behavior and physical properties of Lindbergh heavy oil/ $CO_2$ mixtures" *The Journal of Canadian Petroleum Technology* 29:6 31-39 (Nov.-Dec. 1990).
Zaki et al.; "Polyoxyethylenated Bisphenol-A for Breaking Water-in-oil Emulsions" *Polymers for Advanced Technologies* 7:805-808 (1996).

(Continued)

*Primary Examiner*—Tam M Nguyen
(74) *Attorney, Agent, or Firm*—Myers Bigel Sibley & Sajovec

(57) ABSTRACT

A method of deresinating a crude oil comprises contacting the crude oil with a carbon dioxide containing fluid, the crude oil having an initial API gravity and comprising an oil phase, resins, and asphaltenes, and wherein the carbon dioxide containing fluid enters the oil phase of the crude oil in a manner such that the resins and asphaltenes precipitate out of the crude oil such that the final API gravity of the crude oil is higher than the initial API gravity of the crude oil.

18 Claims, 6 Drawing Sheets

OTHER PUBLICATIONS

Zaki et al.; "De-emulsifiers for water-in-crude oil-emulsions" *Tenside Surf. Det*. 34:12-17 (1997).

Zaki, et al.; U.S. Appl. No. 09/598,863, filed Jun. 21, 2000; Entitled: *Methods of Demulsifying Emulsions Using Carbon Dioxide*.

Burke et al., "Removal of Hydrocarbons from Oilfield Brines by Flocculation with Carbon Dioxide," *Society of Petroleum Engineers*, 21046: 457-465 (1991).

Chung et al., "Measurements and Correlations of the Physical Properties of $CO_2$/Heavy-Crude-oil Mixtures," *SPE Reservoir Engineering*, 822-828 (Aug. 1988).

Höcker et al., "Continuous Deasphalting of Heavy Petroleum Residues with Ethyl Acetate," *Chem. Eng. Technol.*, 10: 125-131 (1987).

Kantar et al., "Heavy Oil Recovery by $CO_2$ Application from Bati Raman Field, Turkey," *Society of Petroleum Engineers*, 11475: 271-276 (1983).

Little, Chester Thomas, "Removal of Petroleum Hydrocarbons from Oil-Field Brines with Carbon Dioxide," *Dissertation, The University of Texas at Austin* (May 1990).

Reid et al., "Lick Creek Meakin Sand Unit Immiscible $CO_2$—Waterflood Project," *Society of Petroleum Engineers*, 9795: 335-339 (1981).

Rojas et al., "Scaled Model Studies of Carbon Dioxide/Brine Injection Strategies for Heavy Oil Recovery from Thin Formations," *The Journal of Canadian Petroleum Technology*, 85-94 (Jan.-Feb. 1986).

Saner et al., "$CO_2$ Recovery of Heavy Oil: Wilmington Field Test," *Journal of Petroleum Technology*, 769-776 (Jul. 1986).

Chierici et al., "$CO_2$-Enriched Natural Gas Injection into a Fractured, Heavy Oil Reservoir: The Ponte Dirillo Field Pilot, Italy," *Agip S.p.A., San Donato Milanese, Italy*, 265-278, 1985: Rome, Italy.

METHODS OF DERESINATING CRUDE OILS USING CARBON DIOXIDE

CROSS-REFERENCE TO RELATED APPLICATIONS

The present application claims priority to Provisional Application Ser. No. 60/232,539 filed Sep. 14, 2000, the disclosure of which is incorporated herein by reference in its entirety.

FIELD OF THE INVENTION

The invention generally relates to the processing of crude oil using carbon dioxide.

BACKGROUND OF THE INVENTION

Crude oil contains a sizeable number of fractions, with asphaltenes and resins being among the heaviest. These two fractions are believed to be largely responsible for most of the problems encountered in the production, transportation, refining, and processing of crude oils. Most commercially valuable petroleum refinery products (e.g., naphtha, mineral oil, gasoline, kerosine, turbine oil, gas oil, diesel oil, lubricating oils, and paraffin waxes) are typically obtained after the removal of asphaltenes and resins from the crude oil.

It is highly desirable for the crude oil producer to remove asphaltenes and resins from the crude oil prior to transporting it to a refinery through pipelines. Pipeline transportation of these heavy crude oils is typically extremely difficult primarily due to the tendency of these materials to emulsify with water. The heavy crude oils are also undesirably highly viscous. Transporting these heavy crudes often requires adding a diluent and/or heating the pipeline. This is undesirable in that it can be very expensive, hazardous, and can result in emission and crude oil light fraction losses. Prolonged use of a particular pipeline to transport heavy crude oils may cause asphaltene deposition which can decrease the throughput of the pipeline and its efficiency.

It is conventionally believed that asphaltenes and resins stabilize water-in-oil crude oil emulsions. Subsequent removal of the asphaltenes and the resins from the crude oil can facilitate breaking the emulsions prior to the transportation of the crude oil. This is advantageous in that it is capable of reducing the cost of transporting wet crude oils and is capable of minimizing or eliminating pipeline corrosion caused by water and salts dissolved in the aqueous phase of the crude oil. Another significant potential advantage associated with the removal of asphaltenes and resins from the crude oil is the consequent reduction in transition metals (e.g., vanadium, nickel, and iron) which are capable of poisoning catalysts used in refineries. Finally, removal of asphaltenes and resins from the crude oil is significant in that it may help mitigate problems relating to the presence of $SO_x$ and $NO_x$ gases in the effluent.

Atmospheric and vacuum distillation has been used as well as clay and sulfuric acid treatment methods in asphaltene and resin removal. Several drawbacks are associated with distillation technology such as high energy consumption, cocking, and the difficulty of removing sulfur and nitrogen from the distillates. Propane deasphalting is a current popular conventional technique used in petroleum refineries. Notwithstanding any advantages, propane deasphalting may be undesirable in that the crude oil should be first dewatered and transported to the refinery before the deasphalting process can be employed. Additionally, propane is highly flammable. Moreover, the separation of propane from both the deasphalted and the residual fractions typically requires the system to be heated which results in additional energy consumption.

There is a need in the art for a deasphalting and deresinating process which addresses the problems set forth above.

SUMMARY OF THE INVENTION

In one aspect, the invention provides a method of deresinating a crude oil. The method comprises contacting the crude oil with a carbon dioxide containing fluid, the crude oil having an initial API (American Petroleum Institute) gravity and comprising an oil phase, resins, and asphaltenes, and wherein the carbon dioxide containing fluid enters the oil phase of the crude oil in a manner such that the resins and asphaltenes precipitate out of the crude oil and the final API gravity of the crude oil is higher than the initial API gravity of the crude oil.

In another aspect, the invention provides a composition of matter. The composition of matter comprisesa crude oil that is at least about 10 percent greater in its API gravity by virtue of contact with a carbon dioxide containing fluid that has caused asphaltenes and resins to precipitate from the crude oil.

A further aspect of the invention is deresinated crude oil products produced by the methods described herein.

This and other aspects and advantages of the invention are set forth in detail herein.

DETAILED DESCRIPTION OF THE PREFERRED EMBODIMENTS

Figure 1:
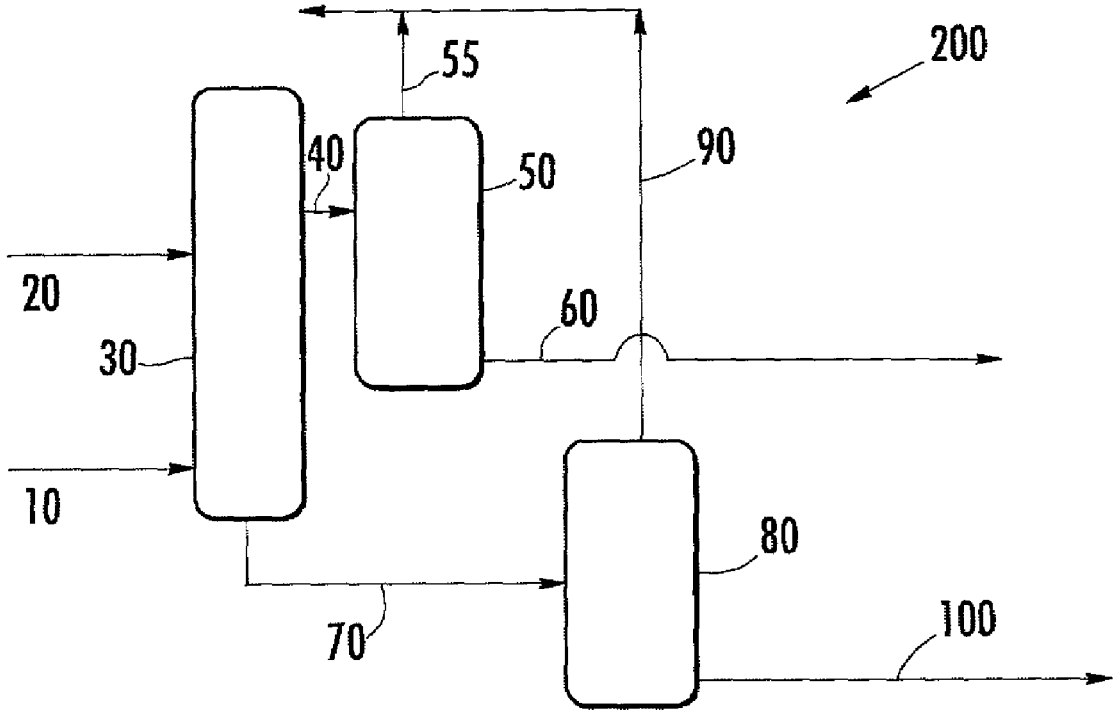
FIG. 1 illustrates a system for carrying out a method of the invention.

The present invention now will be described more fully hereinafter with reference to the accompanying specification, drawings, and examples, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

In one aspect, the invention provides a method of deresinating a crude oil. The method comprises contacting the crude oil with a carbon dioxide containing fluid, the crude oil having an initial API gravity and comprising an oil phase, resins, and asphaltenes, and wherein the carbon dioxide containing fluid enters the oil phase of the crude oil in a manner such that the resins and asphaltenes precipitate out of the crude oil such that the final API gravity of the crude oil is higher than the initial API gravity of the crude oil.

In one embodiment, the processed crude oil contains a carbon dioxide soluble fraction which includes the resins and asphaltenes. In these instances, the method of the invention may optionally further comprise the step of separating the resins and asphaltenes from the carbon dioxide soluble fraction. Additionally, in other embodiments, the method may comprise the step of separating the carbon dioxide from the crude oil and recycling the carbon dioxide (e.g., by re-using the carbon dioxide to deresinate additional crude oil by the instant process, ether continuously or in a batch-wise fashion).

Crude oil, e.g., heavy or light oil, is processed in accordance with the invention. The term "heavy oil" refers to crude oil having an API gravity less than 20 and a viscosity higher than 100 cp and up to 10,000 cp at 20° C. In a typical embodiment, heavy crude oil has a relatively high asphaltene content with a relatively low hydrogen-to-carbon (H/C) ratio. The term "light oil" refers to crude oil having an API gravity higher than 20 and a viscosity less than 100 cp at 20° C. In a typical embodiment, light crude oil has a relatively low asphaltene content with a relatively high H/C ratio. See e.g., *The Chemistry and Technology of Petroleum,* $2^{nd}$ Ed., James G. Speight, (1991), pp. 3-5. Preferred crude oils that are employed in the method of the invention includes, but is not limited to, Arab Berri, Hondo, and B6 crude oils. A preferred H/C ratio for the crude oil ranges from about 1.5 to about 1.9.

In one embodiment, the crude oil has an initial API gravity ranging from about 0.7, 1, 10, or 15 to about 20, 25, 30 or 35. As an example, the method of the invention may be employed such that the crude oil has a final API gravity ranging from about 10, 15, or 20 to about 30, 35, 40, 47, or 50. It should be appreciated that other API gravity values are contemplated within the scope of the invention.

For the purposes of the invention, the term "asphaltenes" is defined to be components of the high boiling point fraction of the crude oil which are composed of polynuclear aromatic hydrocarbons of molecular weights ranging from 500 to 2000 or greater and aggregate molecular weights of up to 20,000 joined by alkyl chains. See e.g., *Hawley's Condensed Chemical Dictionary,* $12^{th}$ Ed., Richard J. Lewis, Sr., Editor, (1993), p. 101. Various amounts of asphaltenes may be present in the crude oil. For example, in a preferred embodiment, the crude oil may include from about 0.1, 1, or 5, to about 10, 15, or 20 percent by weight of asphaltenes. It should be appreciated that other amounts are encompassed by the invention.

The term "resins" refers to the fraction of maltenes that are soluble in an acetone-methylene-chloride-toluene mixture. As known in the art, maltenes is that portion of petroleum that is soluble in heptane. In general, in comparison to asphaltenes, resins are less aromatic (have higher H/C ratio, e.g., from about 1.25 to about 1.7) and have lower molecular weights (e.g., from about 400 to about 1000). The resin content of crude oils often vary markedly from one crude oil to another and it generally ranges from about 3 to about 40 weight percent, although other values are encompassed for the purposes of the invention.

In a typical embodiment, the crude oil may include water. The water may include any number of different additives (e.g., scale inhibitors, corrosion inhibitors, $H_2S$ scavengers, and biocides), buffers, and the like, the selection being known to one skilled in the art. Preferably, the crude oil comprises from about 1, 2, 5, 10, 15, or 20 to about 25, 30, 40, 50, or 60 vol/vol percent of the water.

In one embodiment, the water may include at least one inorganic salt. Examples of inorganic salts include, without limitation, sodium chloride, calcium chloride, sodium sulfate, magnesium chloride, sodium carbonate, and magnesium sulfate, and calcium. Mixtures thereof can also be used. Preferably, the salt concentration in the water ranges from about 1, 10, or 100 ppm to about 1, 5, 10 or 15 wt/vol percent.

For the purposes of the invention, carbon dioxide may be employed in the carbon dioxide-containing fluid in a liquid or supercritical phase. If liquid $CO_2$ is used, the temperature employed during the process is preferably below 31.04° C. If supercritical $CO_2$ is used, it is preferred that the phase be employed at high pressure above 1070 psi and temperature above 31.04° C. As used herein, the term "high pressure" generally refers to $CO_2$ having a pressure from about 1000 to about 4500 psi. In a preferred embodiment, the $CO_2$ is utilized in a "supercritical" phase. As used herein, "supercritical" means that a fluid medium is above its critical temperature and pressure, i.e., above 31.04° C. and above 1070 psi for $CO_2$. The thermodynamic properties of $CO_2$ are reported in Hyatt, *J. Org. Chem.* 49: 5097-5101 (1984); therein, it is stated that the critical temperature of $CO_2$ is 31.04° C.; thus the method of the present invention may be carried out at a temperature above 31.04° C. A preferred pressure of the carbon dioxide containing fluid ranges from about 500, 1000 or about 3000 psi to about 3500 or 4500 psi. A preferred temperature of the carbon dioxide fluid ranges from about 25° C. to about 70° C. In general, embodiments in which the temperature is 50° C. or higher are particularly preferred.

The method of the invention may take place over various time periods, the selection of which may be determined by a person who is skilled in the art. Preferably, the method is carried out for a time of about 15, 30, 60, or 90 minutes to about 5, 10, or 24 hours.

The carbon dioxide containing fluid may include other components such as, for example, co-solvents, surfactants, co-surfactants, buffers, rheology modifiers, biological agents, and viscosity reduction modifiers. Other components may be used in the carbon dioxide containing fluid, the selection of which may be determined by the skilled artisan.

A wide variety of co-solvents can be used. Exemplary co-solvents include, but are not limited to, n-pentane, hexanes, cyclohexane, n-heptane, methanol, ethanol, isopropanol, ethylene glycol, propylene glycol, methyl-isopropyl ketone, benzene, toluene, xylenes, terpenes, paraffins, and mixtures thereof.

FIG. 1 illustrates a system 200 for carrying out the method of the invention. In general, the method of the invention may be carried out by first contacting a carbon dioxide containing fluid 10 with crude oil or heavy feedstock 20 in a settling vessel 30. The resins and asphaltenes are precipitated and the mixture may thereafter be filtered. Alternatively, the $CO_2$ soluble fraction 40 may be conveyed from the upper portion of vessel 30 to evaporator 50. Carbon dioxide is depressurized and recovered in the upper portion of evaporator 50 and is recycled continuously while deresinated and deasphalted crude oil 60 is drawn off of the bottom of the evaporator 50.

Carbon dioxide insoluble heavy residue fraction 70 is drawn off of the bottom of the settling vessel 30, and is conveyed to evaporator 80. Carbon dioxide is depressurized and recycled continuously (see stream 90) while an asphalt fraction 100 is drawn off from the bottom of evaporator 80.

In another aspect, the invention relates to a composition of matter. The composition of matter comprises a crude oil that has experienced at least about a 5, 10, or 15 percent increase in its API gravity by virtue of contact with a carbon dioxide containing fluid that has caused asphaltenes and resins to precipitate from the crude oil.

The examples are set forth to illustrate the invention and are not meant as a limitation on the scope of the invention. In the examples, the amount of precipitated asphaltenes and resins are determined quantitatively by the following method. An experimental setup depicted in FIG. 1 is used to determine the amount precipitated. Accurately weighed (i.e., to the nearest 0.1 mg) B6 asphaltenes or B6 resins are dissolved in 10 ml toluene to form a 1 weight/volume percent solution. The model oil solution or crude oil is delivered quantitatively to the view cell, and pressurized with $CO_2$ by means of the syringe pump to the desired pressure (e.g., 1000 to 2000 psi). In the event that stirring is to be employed, suitable stirring means (e.g., a magnetic stirring bar) is placed in the system and the view cell is mounted on a magnetic stirrer adjusted to 500 rpm.

The system is left for a desired period of time after which the solvent is conveyed under $CO_2$ pressure through a 1.5 μm line filter to a collecting cell. The system is washed with liquid $CO_2$ several times. The system is then depressurized from the $CO_2$ and the precipitated fraction left in the view cell is quantitatively removed by dissolving it in methylene chloride. Likewise, the dissolved fraction located in the collecting cell is quantitatively retrieved by dissolving it in methylene chloride. Both fractions are collected in tarred glass bottles and placed in a vacuum oven to evaporate the solvent until it achieves constant weight. The weights of both the precipitated and the dissolved fractions are determined and the percent precipitated and soluble were obtained.

EXAMPLE 1

Model Oil Preparation

Asphaltenes are first precipitated from B6 crude oil by n-heptane addition (40:1 vol:vol n-heptane: crude oil). The heptane-soluble fraction of the crude oil which is termed maltenes is subjected to sequential elution column chromatography to isolate the saturates, the aromatics, and the resins. Silica gel containing maltenes is packed in a column overlaying pure activated silica gel. Heptane is used first to elute the aromatics followed by a 1:1 by volume mixture of heptane and toluene to elute the aromatics. Subsequently, a mixture comprising 40 percent acetone/30 percent toluene/30 percent methylene chloride is used to elute the resins. Solvent-free asphaltenes and resins are stored under an argon atmosphere.

The model oils were prepared by weighing asphaltenes and/or resins to the nearest 0.1 mg and dissolving them in toluene or mixtures of toluene and heptane having different proportions of the two components.

EXAMPLE 2

Crude Oil Preparation

In an attempt to ensure homogeneity of the oil samples, the whole crude is mixed thoroughly with the use of a Harbil GQM high speed paint mixer made commercially available by Fisher Scientific of Pennsylvania for 3 minutes.

EXAMPLE 3

Kinetics of Asphaltene Precipitation

The kinetics of asphaltene precipitation from a toluene solution using $CO_2$ is measured. The following conditions were employed: 1 weight percent asphaltene dissolved in toluene at 25° C. is contacted with 1000 psi of $CO_2$ at different time intervals ranging from 30 minutes to 24 hours.

Figure 2:
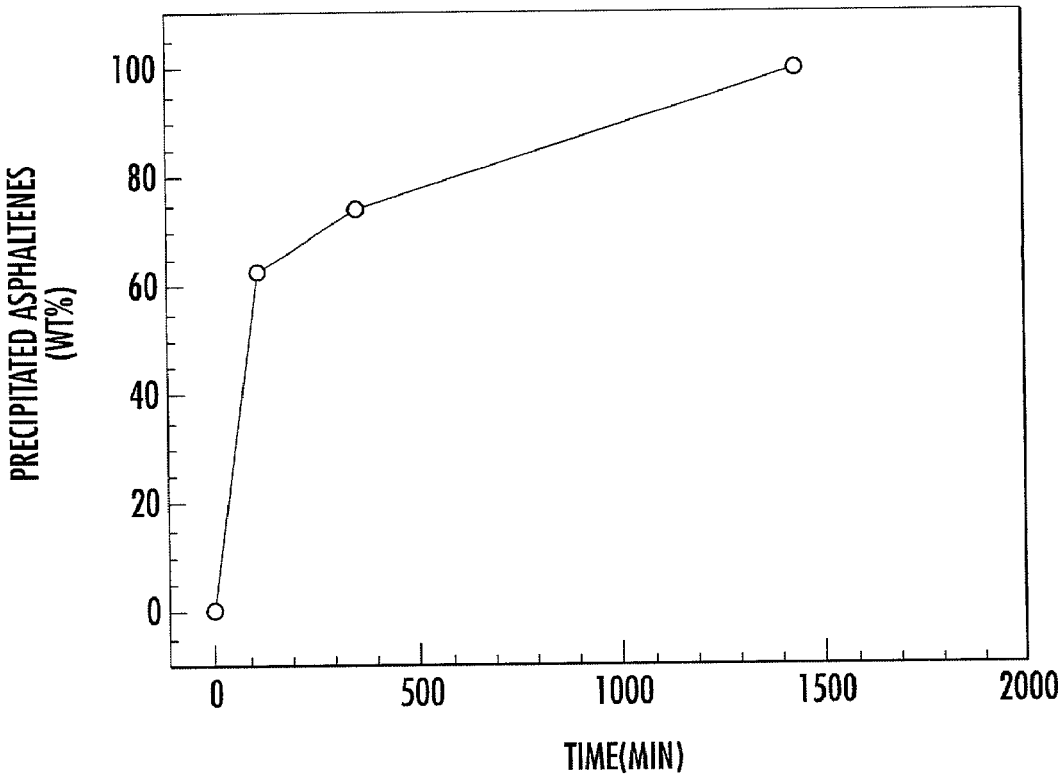
FIG. 2 is a graph illustrating asphaltene precipitation from crude oil as a function of time.

The results of the study are illustrated in FIG. 2. As shown, the amount of asphaltene precipitation generally increases with time and complete precipitation occurs at approximately 24 hours.

EXAMPLE 4

Effect of Temperature and Pressure on the Rate of Asphaltene Precipitation

Figure 3:
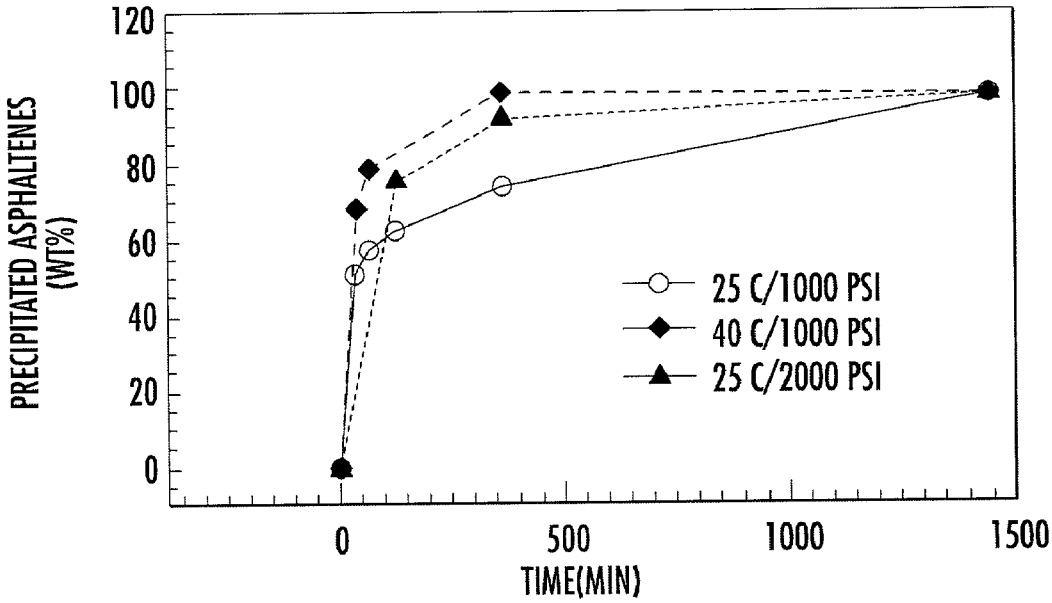
FIG. 3 is a graph illustrating the effect of $CO_2$ temperature and pressure on asphaltene precipitation from crude oil.

The effect of temperature and pressure of $CO_2$ on rate of asphaltene precipitation is carried out for three conditions: (a) 25° C., 1000 psi, (b) 40° C., 1000 psi, and (c) 25° C., 2000 psi. The results are set forth in FIG. 3. In general, increases in temperature and/or $CO_2$ pressure result in increases in asphaltene precipitation, all other variables being constant.

EXAMPLE 5

Effect of Stirring on the Rate of Asphaltene Precipitation by $CO_2$

Figure 4:
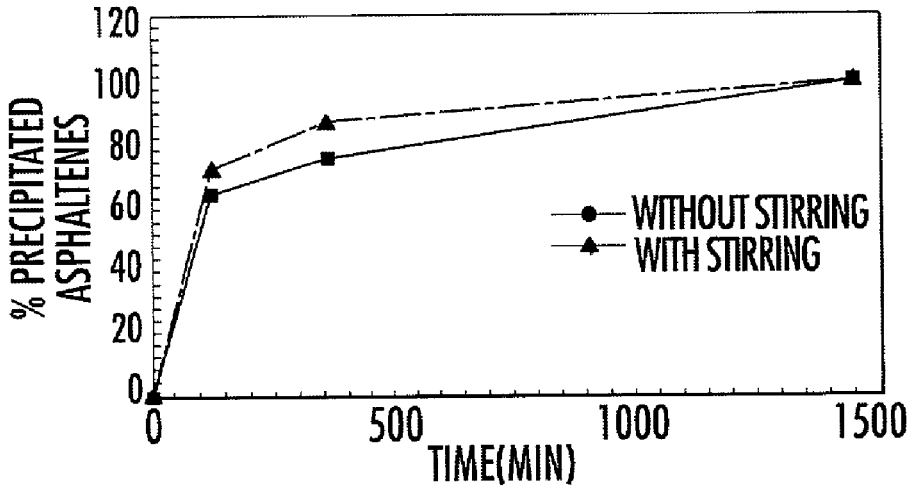
FIG. 4 is a graph illustrating the effect of stirring on the rate of asphaltene precipitation from crude oil.

The effect of stirring on the rate of asphaltene precipitation by $CO_2$ is evaluated and the results are set forth in FIG. 4. The $CO_2$ pressure is 1000 psi and the extraction temperature is 25° C. As seen in FIG. 4, the rate of precipitation generally increases with stirring.

EXAMPLE 6

Effect of Solvent Aromaticity Precipitation by $CO_2$

Figure 5:
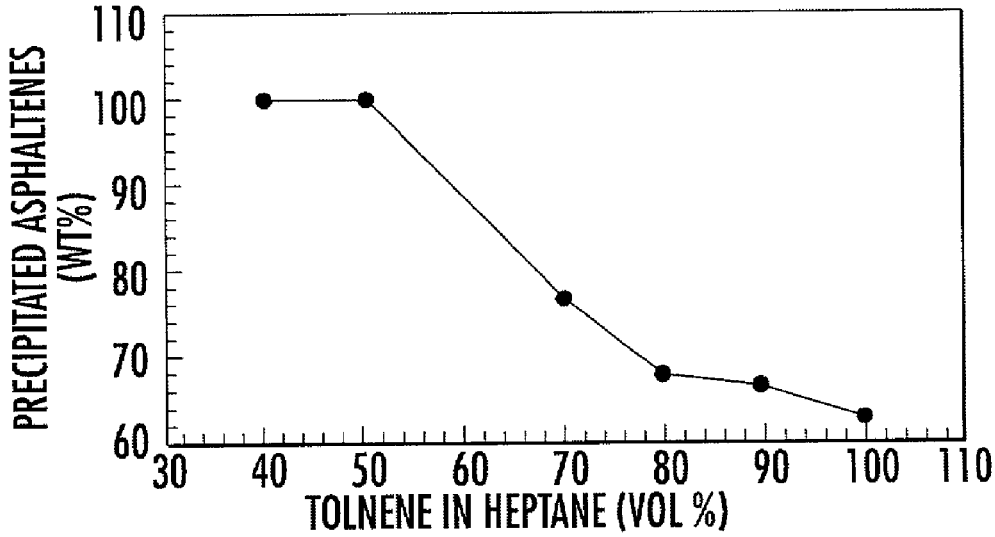
FIG. 5 is a graph illustrating the effect of varying toluene to heptane ratio on asphaltene precipitation from crude oil.

FIG. 5 illustrates the effect of varying the toluene to heptane ratio on asphaltene precipitation. The conditions employed are as follows: 1 weight percent asphaltenes dissolved in different toluene: heptane ratios after a 2 hour residence time at 25° C. and 1000 psi $CO_2$ pressure. FIG. 5 shows that the percent asphaltene precipitation decreases as the relative amount of toluene to heptane increases.

EXAMPLE 7

Effect of Solvent Aromaticity Precipitation by $CO_2$

Figure 6:
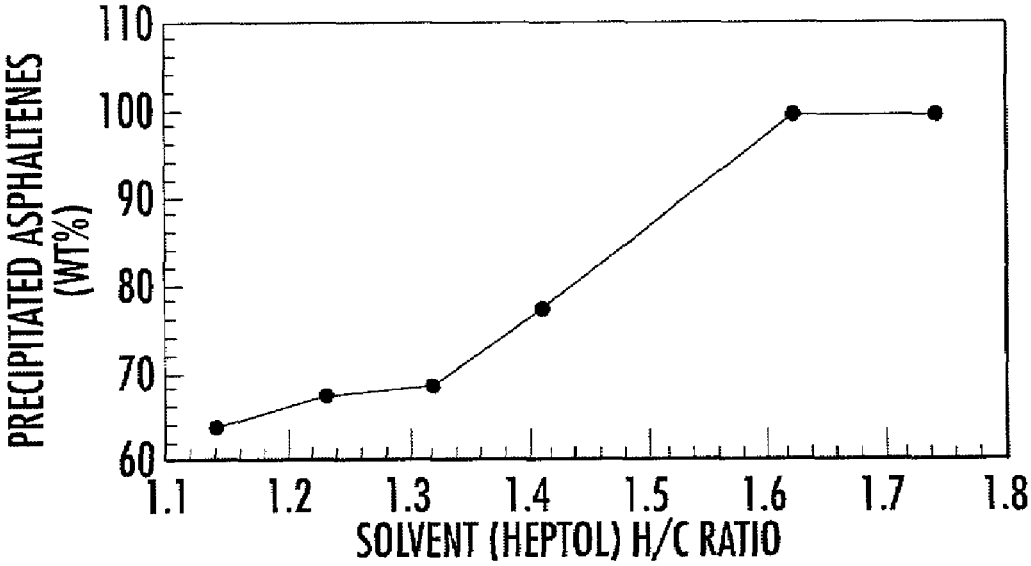
FIG. 6 is a graph illustrating the effect of varying solvent H/C ratio on asphaltene precipitation from crude oil.
Figure 7:
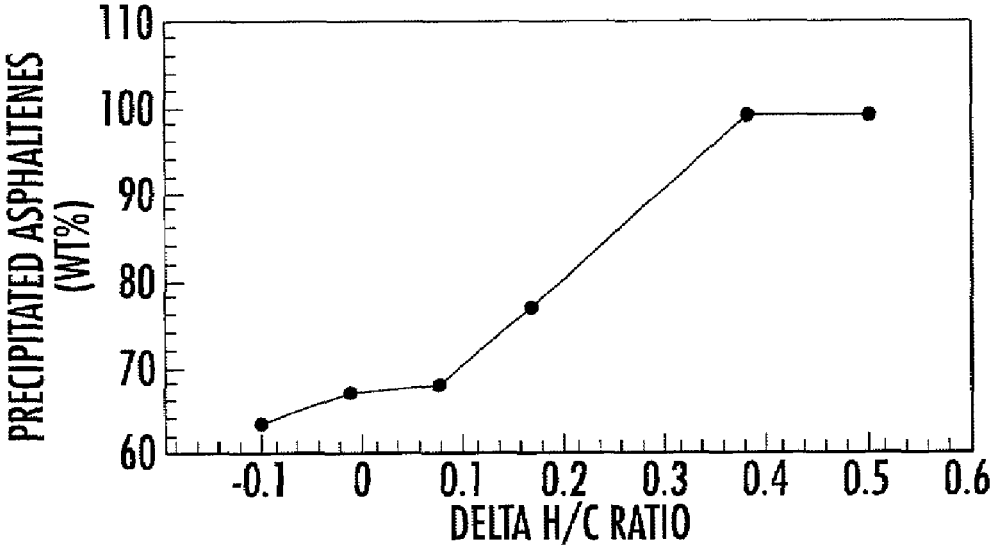
FIG. 7 is a graph illustrating the effect of varying solvent delta H/C ratio on asphaltene precipitation from crude oil.

FIG. 6 illustrates the effect of varying the solvent H/C ratio on asphaltene precipitation. The conditions employed are as follows: 1 weight percent asphaltenes dissolved in different toluene: heptane ratios after 2 hour residence times at 25° C. and 1000 psi $CO_2$ pressure. FIG. 6 shows that the percent asphaltene precipitation increases as the solvent H/C ratio increases. This suggests that crude oils having a higher paraffin content will result in faster asphaltene precipitation. This is also illustrated in FIG. 7.

EXAMPLE 8

Effect of Adding Water on the Rate of Asphaltene Precipitation by $CO_2$

Figure 8:
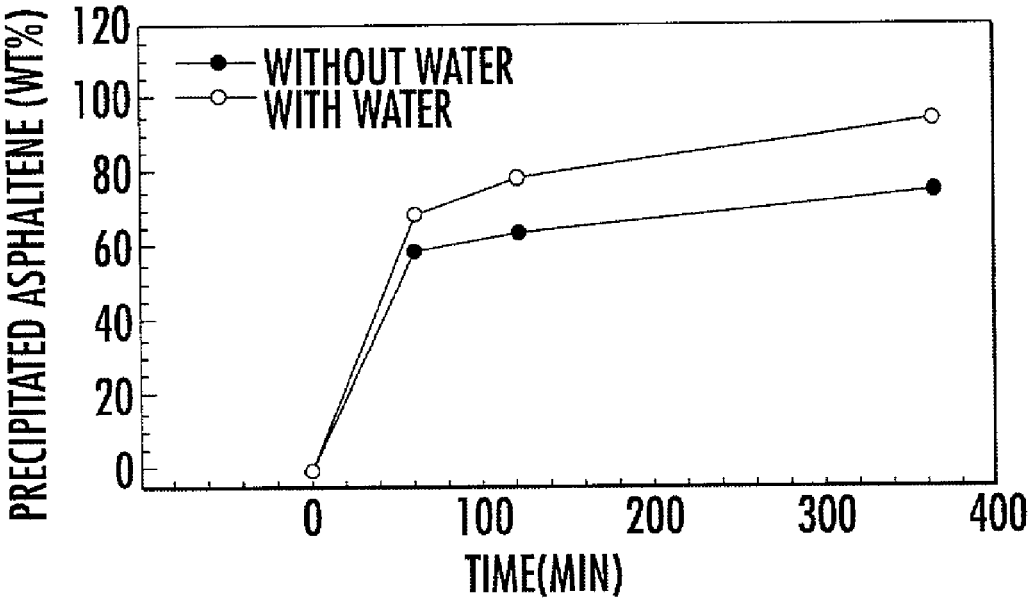
FIG. 8 is a graph illustrating the effect of adding water to crude oil on asphaltene precipitation from crude oil.

The effect of adding water to the crude oil on asphaltene precipitation is investigated. $CO_2$ was employed having a pressure of 1000 psi. The precipitation is carried out at a temperature of 25° C. The results are set forth in FIG. 8. As seen, the effect of adding water results in faster asphaltene precipitation.

EXAMPLE 9

Effect of $CO_2$ Pressure on Resin Precipitation

Figure 9:
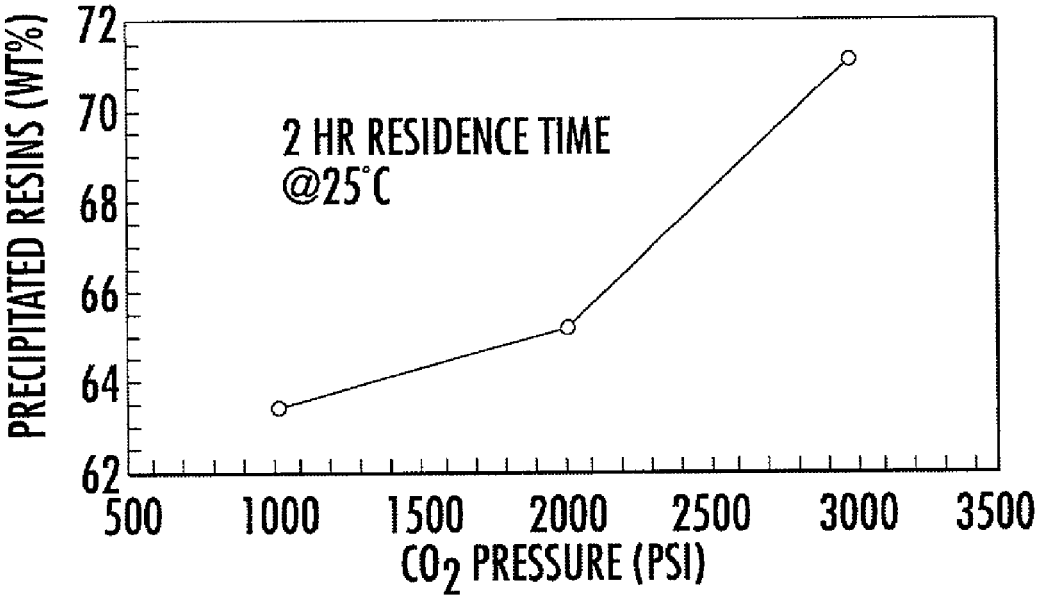
FIG. 9 is a graph illustrating the effect of $CO_2$ pressure on resin precipitation from crude oil.

The effect of $CO_2$ pressure on crude oil resin precipitation is investigated. The precipitation was carried out at 25° C., for a 2 hour residence time. The results are illustrated in FIG. 9. As is shown, the percentage of precipitated resins increases as a function of $CO_2$ pressure.

EXAMPLE 10

Effect of $CO_2$ Pressure and Time on Resin Precipitation

Figure 10:
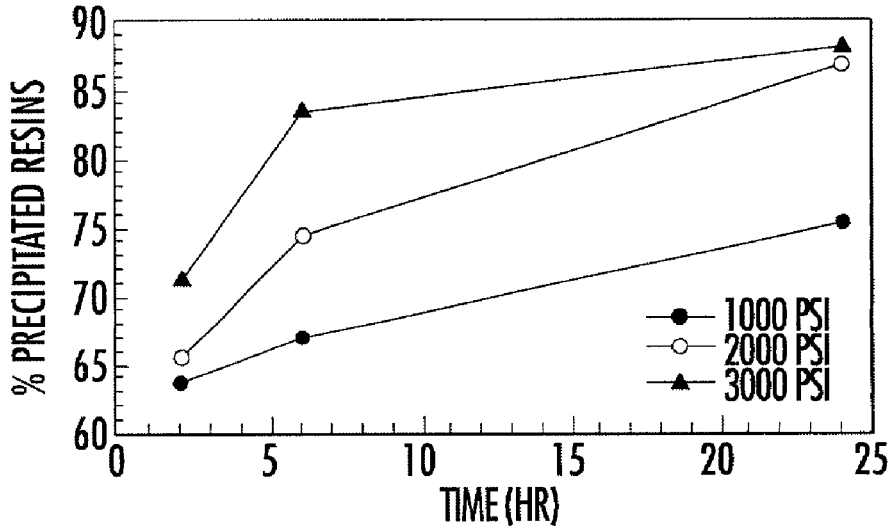
FIG. 10 is a graph illustrating the effect of $CO_2$ pressure and time on resin precipitation from crude oil.

The effect of $CO_2$ pressure and time on crude oil resin precipitation is investigated. The precipitation was carried out at 25° C. for a 2 hr residence time. The results are illustrated in FIG. 10. As is shown, the percentage of precipitated resins increases as a function of both $CO_2$ pressure and time.

EXAMPLE 11

Effect of Asphaltene and Resin Precipitation

Figure 11:
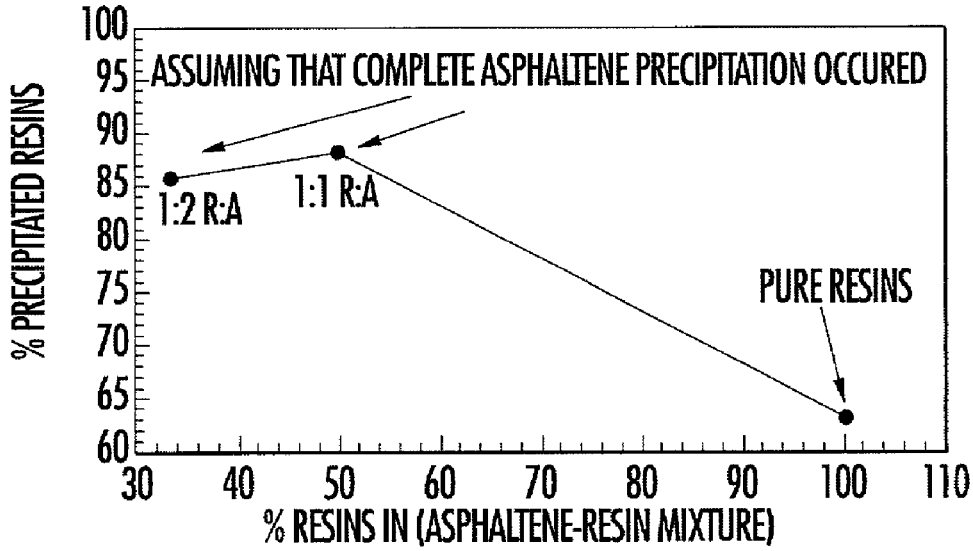
FIG. 11 is a graph illustrating the relationship between resin precipitation and crude oil resin to asphaltene ratios.

The dependence of resin precipitation by $CO_2$ as a function of various resin to asphaltene ratios is investigated. The conditions for the investigation are as follows: 50:50 heptane: toluene solvent mixture ratio, 1000 psi $CO_2$ pressure, 25° C., and a 2 hr residence time. Under these conditions, when the asphaltenes were present alone, 100 percent precipitation is realized after 2 hours. When the resins are present alone under these conditions, 63.7 percent precipitation is realized. When asphaltenes and resins are present in a mixture under these conditions, complete asphaltene precipitation and partial resin precipitation are realized. The maximum amount of precipitated resins are obtained when the ratio of asphaltenes to resins is 1:1 by weight. The results of this investigation are set forth in FIG. 11.

The invention is illustrated by reference to the above embodiments. It should be appreciated however that the invention is not limited to these embodiments but is instead defined by the claims that follow.

That which is claimed:

1. A method of deresinating a crude oil comprising:

contacting the crude oil with a carbon dioxide containing fluid, the crude oil having an initial API gravity and comprising an oil phase, resins, and asphaltenes, and wherein the carbon dioxide containing fluid enters the oil phase of the crude oil so that the resins and asphaltenes precipitate out of the crude oil and the final API gravity of the crude oil is higher than the initial API gravity of the crude oil, wherein the crude oil comprises water and includes from about 20 to about 60 vol/vol percent of the water.

2. The method according to claim 1, wherein the crude oil has an initial API gravity ranging from about 0.7 to about 35.

3. The method according to claim 1, wherein the crude oil has an final API gravity ranging from about 10 to about 50.

4. The method according to claim 1, wherein the carbon dioxide containing fluid comprises supercritical carbon dioxide.

5. The method according to claim 1, wherein the carbon dioxide containing fluid comprises liquid carbon dioxide.

6. The method according to claim 1, wherein the resins and asphaltenes are present in a carbon dioxide soluble fraction of the crude oil and further comprising the step of separating the resins and asphaltenes from the carbon dioxide soluble fraction.

7. The method according to claim 6, further comprising the step of separating the carbon dioxide from the crude oil and recycling the carbon dioxide for re-contacting the crude oil and/or contacting another crude oil.

8. The method according to claim 1, wherein said step of contacting the crude oil with a carbon dioxide containing fluid takes place for a time of about 15 minutes to about 24 hours.

9. The method according to claim 1, wherein the pressure of the carbon dioxide containing fluid ranges from about 500 psi to about 3500 psi and the temperature of the carbon dioxide containing fluid ranges from about 25° C. to about 70° C.

10. The method according to claim 1, wherein the asphaltene content of the crude oil ranges from about 0.1 to about 20 percent by weight.

11. The method according to claim 1, wherein the resin content of the crude oil ranges from about 0.1 to about 30 percent by weight.

12. The method according to claim 1, wherein the hydrogen-to-carbon (H/C) ratio of the crude oil ranges from about 1.5 to about 1.9.

13. The method according to claim 1, wherein the water comprises at least one salt.

14. The method according to claim 13, wherein the salt concentration ranges from about 1 ppm to about 15 wt/vol percent.

15. The method according to claim 13, wherein the at least one salt is selected from the group consisting of sodium chloride, calcium chloride, sodium sulfate, magnesium chloride, and calcium.

16. A method of deresinating a crude oil comprising:

contacting the crude oil with a fluid consisting essentially of carbon dioxide, the crude oil having an initial API gravity and comprising an oil phase, resins, and asphaltenes, and wherein the fluid enters the oil phase of the crude oil so that the resins and asphaltenes precipitate out of the crude oil and the final API gravity of the crude oil is higher than the initial API gravity of the crude oil, wherein the crude oil comprises from about 20 to about 60 vol/vol percent of the water.

17. The method according to claim 16, wherein the fluid consists essentially of supercritical carbon dioxide.

18. The method according to claim 16, wherein the fluid consists essentially of liquid carbon dioxide.

* * * * *